United States Patent [19]

Forrer

[11] 3,975,884

[45] Aug. 24, 1976

[54] METHOD OF FORMING AND LOADING AN ARTICLE CARRIER

[75] Inventor: Homer W. Forrer, Jonesboro, Ga.

[73] Assignee: The Mead Corporation, Dayton, Ohio

[22] Filed: Feb. 9, 1976

[21] Appl. No.: 656,630

Related U.S. Application Data

[62] Division of Ser. No. 580,300, May 23, 1975, Pat. No. 3,955,745.

[52] U.S. Cl. ..... 53/26; 53/32

[51] Int. Cl.[2] ..... B65B 11/00

[58] Field of Search ..... 53/3, 26, 32, 48; 206/428, 434; 224/45 AB, 45 BA; 229/52 B, 52 BC

[56] References Cited

UNITED STATES PATENTS

| | | | |
|---|---|---|---|
| 2,809,484 | 10/1957 | Gentry | 53/26 |
| 3,068,624 | 12/1962 | Linda | 53/26 X |

*Primary Examiner*—Robert L. Spruill

*Attorney, Agent, or Firm*—Walter M. Rodgers; Walter A. Rodgers

[57] ABSTRACT

A generally rectangular wraparound type blank includes a longitudinal generally medially disposed handle interconnected at its ends with side wall forming panels to the bottom of each of which a bottom forming panel is foldably joined and to the diagonal end edges of which web panels are foldably joined and in turn interconnected with the end edges of end wall forming panels via supplementary side wall forming panels. The handle is held in fixed relation atop a group of articles and the ends of the blank are elevated so as to elevate the end wall forming panels and their associated supplementary side wall forming and web panels following which the end wall forming panels are folded outwardly and downwardly into enveloping relationship relative to the group of articles while the ends of the blank are folded downwardly and underneath the group of articles and secured together.

9 Claims, 9 Drawing Figures

METHOD OF FORMING AND LOADING AN ARTICLE CARRIER

This is a division of application Ser. No. 580,300 filed May 23, 1975 and now U.S. Pat. No. 3,955,741.

Known article carriers of the so-called basket articles type are initially formed from a wraparound blank into an open ended tubular sleeve. The blank is constructed so that end wall forming panels disposed adjacent a centrally disposed handle are folded outwardly and downwardly to form the ends of a basket style carrier. Such known carriers, when used to package cylindrical articles, must be preformed into completed condition following which the cylindrical articles to be packaged are loaded into the carrier. Such loading is time consuming and expensive. Known carriers of this type cannot be loaded simultaneously during the formation of the carrier where the artaicles to be packaged are cylindrical objects such as cans having straight side walls because the end forming panels are dimensionally incapable of clearing the tops of the end cans.

According to this invention, preloading of cylindrical objects during formation of the carrier is possible because by the invention the ends of the blank are manipulated upwardly while the handle is held downwardly against the tops of the articles to be packaged and the blank is constructed so that this operation elevates the end wall forming panels. Thus with the panels elevated, adequate clearance is provided between these end wall forming panels and the upper edges of the end articles so that outward and downward folding of the end wall forming panels may be effected without interference or collision with the articles. Downward folding of the ends of the blank into overlapping relationship with each other underneath the group of articles is effected substantially simultaneously with the outward and downward folding of the end wall forming panels which operation is accompanied by inward folding of web panels and of supplementary side wall forming panels by which the end edges of the end wall forming panels are interconnected with the adjacent portions of the side wall forming panels.

For a better understanding of the invention reference may be had to the following detailed description taken in conjunction with the accompanying drawings in which:

FIG. 8 is a view from above of the hand gripping part of the handle shown in normal loaded but ungripped condition; and in which

Figure 1:
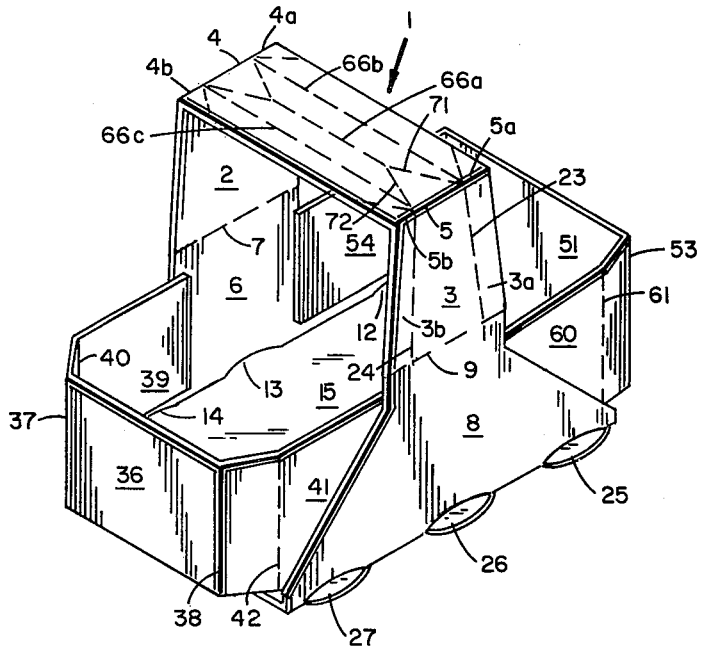
FIG. 1 is a perspective view of a set-up but unloaded basket style carrier formed according to this invention, the cans being omitted for clarity.

In the drawings the numeral 1 depicts the hand gripping central portion of the carrier handle while the numerals 2 and 3 designate weight suspending portions which are foldably joined respectively to the end edges of hand gripping portion 1 along fold lines 4 and 5. As is apparent in the drawings, hand gripping portion 1 of the handle structure which extends between fold lines 4 and 5 is provided with a plurality of longitudinal and angular fold lines which render the handle portion pliable and which thus tend to eliminate undue stresses for example at the ends of the fold lines 4 and 5. It is obvious particularly from FIG. 2 that the handle comprising hand gripping portion 1 and weight suspending portions 2 and 3 is longitudinally and substantially medially disposed with respect to the generally rectangular shaped blank.

Side wall forming panel 6 is foldably joined to the lower edge of weight suspending portion 2 of the handle along an anchoring fold line 7. Similarly, side wall forming panel 8 is foldably joined to the right hand or lower edge of weight suspending portion 3 of the handle along anchoring fold line 9. Fold lines 10 and 11 are formed in weight suspending panel 2 and may extend into side wall forming panel 6, if desired.

A bottom forming panel 15 is foldably joined to the bottom edge of side wall forming panel 6 along intermittent fold line 16 and a plurality of article receiving slits 12, 13 and 14 are disposed along fold line 16. Bottom panel 15 is provided with a plurality of retaining tabs 17, 18, 19 and 20 which are of known construction together with a medial partition panel 21 foldably joined to bottom forming panel 15 along intermittent fold line 22.

Fold lines 23 and 24 are formed in weight suspending panel 3 and may extend into side wall forming panel 8. The fold lines 23 and 24 correspond to fold lines 10 and 11.

A bottom forming panel 28 is foldably joined along intermittent fold line 29 to the right hand or bottom edge of side wall forming panel 8 and a plurality of slits 25, 26 and 27 of known construction are formed along fold line 29. Bottom forming panel 28 is provided with a plurality of locking tabs 30, 31, 32 and 33 which, in a manner well known in the art, are driven respectively into and through the apertures defined by retaining tabs 17, 18, 19 and 20 to secure the inner edges of panels 28 and 15 in overlapping face contacting relation.

It will be understood that for some applications of the invention, the known apertures such as 12, 13, 14, 25, 26, and 27 and the medial panel 21 could be omitted. Furthermore, as is obvious, some means other than the locks 30–33 and the apertures defined by the retaining tabs 17–20 could be employed in order to secure the inner edges of the panels 15 and 28 in face contacting overlapping relation. For most applications of the invention, locks and retaining apertures and their associated tabs are preferred.

The end walls and portions of the side walls of the completed carrier are formed from panels which in the blank are disposed alongside the handle 1, 2, 3 and are separated therefrom by longitudinal slits 34 and 35.

End wall forming panel 36 is provided with a pair of contour lines 37 and 38 and is foldably joined to supplementary side wall forming panel 39 along fold line 40 and to supplementary side wall forming panel 41 along fold line 42. Web panel 43 is foldably joined to supplementary side wall forming panel 39 along fold line 44 and to side wall forming panel 6 along diagonal fold line 45. Fold line 45 intersects the left hand end of slit 35 at a point designated 46 in FIG. 2. Similarly web panel 47 is foldably joined to supplementary side wall panel 41 along fold line 48 and to side wall forming panel 8 along diagonal fold line 49. Fold line 49 intersects the right hand end of longitudinal slit 35 at a point designated 50.

The opposite end of the carrier includes similar structure and comprises end wall forming panel 51 which includes contour lines 52 and 53 and which is foldably joined to supplementary side wall forming panel 54 along fold line 55. Web panel 56 is foldably joined along fold line 57 to an edge of supplementary side wall forming panel 54 and to side wall forming panel 6 along diagonal fold line 58 which intersects the left hand end of longitudinal slit 34 at a point designated at 59.

Supplementary side wall forming panel 60 is foldably joined to end wall forming panel 51 along a fold line 61 and to web panel 62 along fold line 63. Web panel 62 is foldably joined to side wall forming panel 8 along diagonal outwardly divergent fold line 64 one end of which intersects the right hand end of longitudinal slit 34 at a point designated 65.

Figure 2:
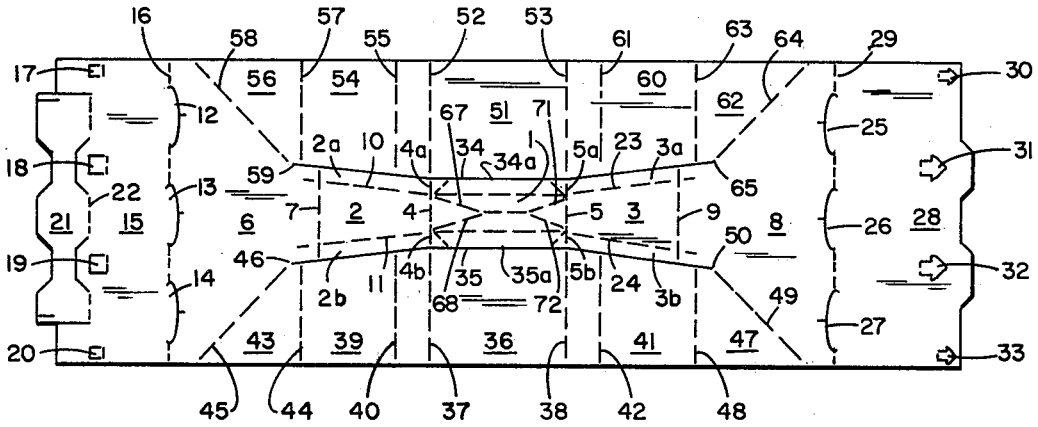
FIG. 2 is a plan view of a blank from which the carrier shown in FIG. 1 is formed.
Figure 3:
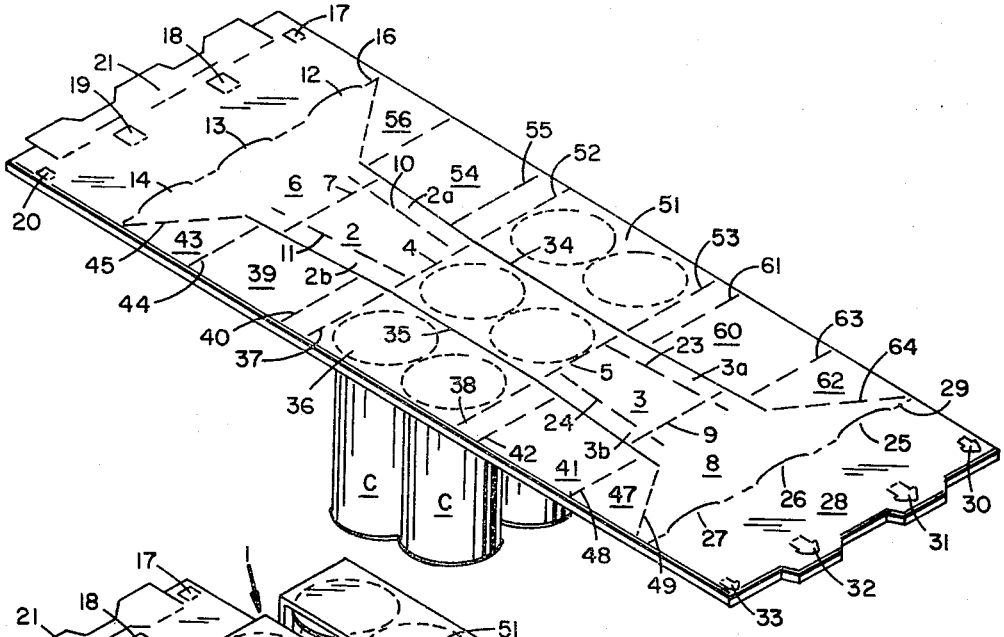
FIG. 3 is a perspective view depicting an initial step in the formation and loading of a carrier according to this invention.
Figure 4:
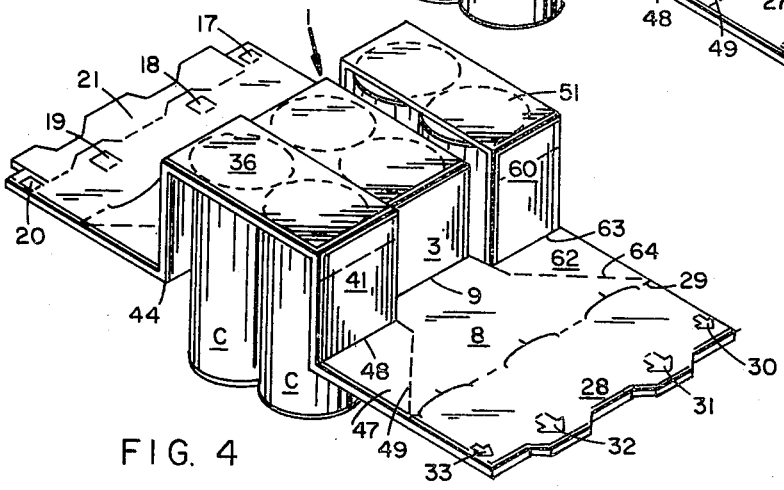
FIG. 4 is a view similar to FIG. 3 and depicts a subsequent stage in the formation and loading of the carrier following the stage depicted in FIG. 3.
Figure 7:
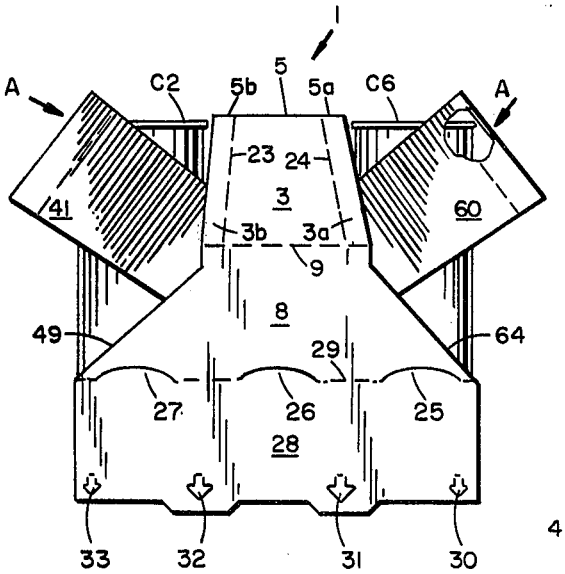
FIG. 7 is a view similar to FIG. 6 but which is taken from the side and which includes the cans.

In order to form and simultaneously load cylindrical objects such as cans C into a completed carrier shown in unloaded condition in FIG. 1, a plurality of cans C are arranged in a rectilinear group which may comprise six cans as shown in FIG. 3. Thereafter the blank of FIG. 2 is placed atop the group of cans C as shown in FIG. 3. With the central hand gripping portion 1 of the handle held in secure and fixed contacting relation to the top of the article group, the weight suspending portions 2 and 3 of the handle are folded downwardly alongside the cans C following which folding operation, the outer ends of the blank are elevated as depicted for example in FIG. 4. Since the elevating fold lines 44 and 57 are disposed outwardly toward the left hand end of the blank relative to the anchoring fold line 7, and since the elevating fold lines 48 and 63 are disposed outwardly and toward the right relative to anchoring fold line 9, it is apparent from FIG. 4 that downward folding of weight supporting portions 2 and 3 of the handle followed by upward folding of the ends of the blank imparts an elevating and lifting action to end wall forming panel 51 and its associated side wall forming panels 54 and 60 on one side of the blank. Simultaneously end wall forming panel 36 and its associated supplementary side wall forming panels 39 and 41 are elevated. This action is in accordance with a feature of this invention and is the means by which the end wall forming panels 36 and 51 a re moved upwardly and into a positon from whence these panels may be folded outwardly and downwardly and in a clearing relationship relative to the end cans designated C1, C2, C5 and C6. In FIG. 7, this clearance distance is observable at the area generally designated by the arrow A.

Figure 5:
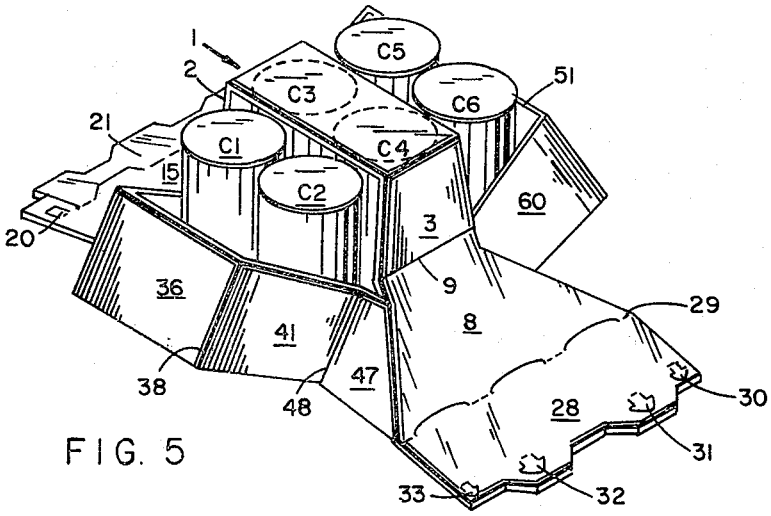
FIG. 5 depicts a subsequent stage in the manipulation of the carrier from that shown in FIG. 4.
Figure 6:
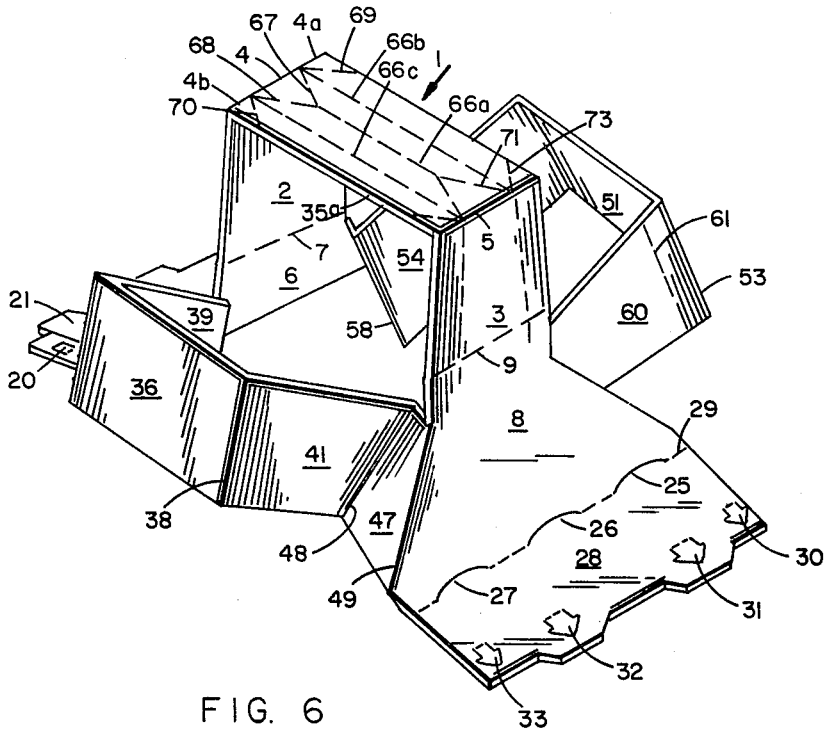
FIG. 6 is a view similar to FIG. 5 but with the cans omitted for clarity.

With the parts in the positions depicted in FIG. 5, continued downward movement of end wall forming panels 36 and 51 accompanied by angular and inward folding of supplementary side wall forming panels 39, 41, 54, and 60 is simultaneously effected by downward folding of side wall forming panels 8 and 6 and of bottom wall forming panels 15 and 28. This folding operation when completed to the point wherein the side wall forming panels 6 and 8 are substantially vertically disposed causes the web panels 43 and 56 to swing inwardly along diagonal fold lines 45 and 58 respectively to occupy positions of flat face contacting relation with respect to the side wall forming panel 6. Supplementary side wall forming panels 39 and 54 are simultaneously folded along fold lines 44 and 57 into flat face contacting relation to web panels 43 and 56 so that web panel 43 is interposed between supplementary side wall forming panel 39 and the inner surface of side wall forming panel 6. Similarly web panel 56 when completely folded is interposed between supplementary side wall forming panel 54 and the inner surface of side wall forming panel 6. Simultaneously when side wall forming panel 8 reaches a substantially vertical disposition, web panels 47 and 62 are disposed in flat face contacting relation with respect to the inner surface of side wall forming panel 8 due to the fact that these web panels have been folded inwardly along their respective fold lines 49 and 64. Simultaneously, supplementary side wall forming panels 41 and 60 are folded along fold lines 48 and 63 into positions of flat face contacting relation with respect to the associated web panels 47 and 62 so that web panel 47 is interposed between supplementary side wall forming panel 41 and the inner surface of side wall forming panel 8. Similarly web panel 62 when completely folded is interposed between supplementary side are panel 60 and the inner position of side wall forming panel 8. Of course the end walls are completely formed when the downward folding of end wall forming panels 36 and 51 is completed and such action preferably accompanies the completion of the downward folding of side wall forming panels 6 and 8 and the end wall forming structure associated therewith.

With the side and end walls completely formed, it is simply necessary then to fold the bottom forming lap panel 15 inwardly and underneath the article group in known manner while the panel 21 is folded into normal relationship with respect to panel 15 and simultaneously interposed between the rows of cans to form a medial partition for the carrier. Bottom forming lap panel 28 is folded inwardly and into overlapping relation with respect to panel 15. With the parts properly positioned, the locks 30–33 are driven in known manner through the apertures defined by retaining tabs 17–20 respectively. Upon completion of this bottom locking operation the carrier is completely formed and of course is already loaded in accordance with this invention.

As is apparent from FIGS. 5 and 7 and from the above description, there is minimal clearance between the upper ends of articles such as cans C3 and C4 and the lower surface of the hand gripping portion 1 of the handle although there is finger receiving space intermediate cans C1 and C2 and the edge **35*a* of the hand gripping portion 1 of the handle. Similarly there is finger receiving space between the upper ends of cans C5 and C6 and the edge 34*a* of hand gripping portion 1 of the handle. Thus with a thumb and finger inserted adjacent the edges 35*a* and 34*a* of the handle, an upward force imparts an accordian like folding action to the hand gripping portion of the handle as well as an arcuate bending action to weight supporting portions 2 and 3 of the handle which causes the weight supporting portions at least partially to conform with the arcuate upper ends of cans C3 and C4. This arcuate bending tends to minimize the stress imposed at the ends of handle fold lines 4 and 5 and also facilitates the manipulation of the hand gripping portion 1** of the handle into an accordian like structure.

Figure 8:
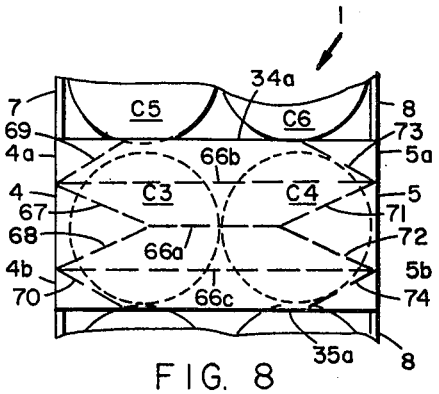

The above described manipulation of the handle is facilitated by the special construction of the handle as best shown in FIG. 8 wherein parallel longitudinally disposed fold lines 66*a*, 66*b* and 66*c* are shown. A pair of angularly disposed fold lines 67 and 68 intersect each other and the left hand end of fold line 66*a*. An angularly disposed fold line 69 intersects the left hand end of fold line 67 and handle fold line 4 and a corresponding fold line 68 intersects the left hand end of fold line 66*a* and handle fold line 4.

Angularly disposed fold lines 71 and 72 intersect each other and coincide at their left hand ends with the right hand end of fold line 66*a* while diagonal fold line 73 at its right hand end intersects handle fold line 5 and the right hand end of fold line 71 and an angularly disposed fold line 74 intersects fold line 72 and handle fold line 5.

As is apparent in FIG. 1, for example, fold line 23 formed in panel 3 is in a sense a continuation of the right hand end of fold line 66*b*. Line 23 could extend fold line 71 if desired. Similarly fold line 24 is in effect a substantially straight continuation of fold line 66*c* but could simply extend fold line 72. In like fashion fold lines 10 and 11 constitute vertical continuations of the left hand ends of fold lines 66*b* and 66*c* or could extend fold lines 67 and 68.

Figure 9:
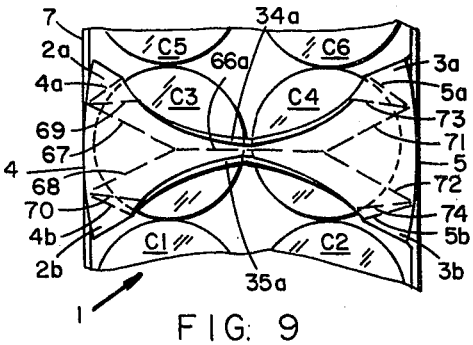
FIG. 9 is a view similar to FIG. 8 but which shows the parts in gripped load bearing condition.

Thus with the handle structure disposed in a plane as shown for example in FIGS. 1, 5, 6, 7 and 8, a finger gripping sidewise and upward lifting force is applied to edges 34*a* and 35*a*. This force causes the handle gripping portion 1 of the handle to form an accordian like structure wherein the mid portion of the edge 34*a* is disposed immediately adjacent the mid portion of the edge 35*a* and the medial fold line 66*a* is interposed between edges 34*a* and 35*a* as shown in FIG. 9. This action causes fold lines 69 and 70 to swing from their angular positions as shown in FIG. 8 to positions shown in FIG. 9. Similarly fold lines 73 and 74 which are angularly disposed with respect to the longitudinal fold lines 66*a*, 66*b* and 66*c* in FIG. 8 when in relaxed collapsed condition move to the positions shown in FIG. 9. Furthermore the handle fold lines 4 and 5 which are substantially straight and parallel to each other when the handle is in relaxed condition as shown in FIG. 8 assume an arcuate configuration as shown in FIG. 9 which tends to cause the weight suspending portions 2 and 3 of the handle to conform to some extent to the upper ends of the cans C3 and C4 respectively thereby to minimize the stress imposed at the ends of handle fold lines 4 and 5 and also to provide an upwardly extending gripping area which may readily be grasped in order to transport the carrier and its contents.

The embodiments of the invention in which an exclusive property or privilege is claimed are defined as follows:

1. A method of forming and loading a basket style article carrier from a generally rectangular wraparound type blank having a longitudinal medial handle interconnected at its ends with side wall forming panels along transverse anchoring fold lines and having a pair of end wall forming panels disposed alongside opposite sides of said handle and interconnected at their ends with said side wall forming panels via interconnected web and supplementary side wall forming panels, the connection between each web panel and its associated supplementary side wall forming panel being along a transverse elevating fold line spaced outwardly toward the ends of the blank from the associated anchoring fold line and the connection between each web panel and the associated side wall forming panel being along a diagonal fold line, the method comprising the steps of forming a group of articles in a rectilinear side by side arrangement, placing the blank atop the group of articles, holding the handle in fixed relation atop the group of articles, folding the ends of the handle downwardly, folding the ends of the blank upwardly along said anchoring fold lines so as to elevate said end wall forming panels and said supplementary side wall forming panels relative to the handle and to the group of articles, folding said end wall forming panels outwardly and downwardly, folding the ends of the blank downwardly and underneath the group of articles, and securing the ends of the blank together.

2. A method according to claim 1 wherein upward folding of the ends of the blank imparts upward movement to said elevating fold lines relative to the associated anchoring fold line.

3. A method according to claim 1 wherein downward folding of said end wall forming panels and of the ends of the blank causes said web panels to swing into flat face contacting relation with the inner surface of the associated side wall forming panels.

4. A method according to claim 1 wherein downward folding of said end wall forming panels and of the ends of the blank causes said supplementary side wall forming panels to swing into flat face contacting relation with the associated web panels.

5. A method according to claim 1 wherein downward and outward folding of said end wall forming panels is effected substantially simultaneously with downward folding of the ends of the blank.

6. A method according to claim 1 wherein downward folding of said end wall forming panels and of the ends of the blank causes said web panels to occupy positions between the associated side wall forming panel and the associated one of said supplementary side wall forming panels.

7. A method of forming and loading a basket style article carrier from a generally rectangular wraparound type blank having a longitudinal medial handle interconnected at its ends with side wall forming panels along transverse anchoring fold lines and having a pair of end wall forming panels disposed alongside opposite sides of said handle and interconnected at their ends with said side wall forming panels via interconnected web and supplementary side wall forming panels, the connection between each web panel and its associated supplementary side wall forming panel being along a transverse elevating fold line and the connection between each web panel and the associated side wall forming panel being along a diagonal fold line, the method comprising the steps of forming a group of articles in a rectilinear side by side arrangement, placing the blank atop the group of articles, holding the handle in fixed relation atop the group of articles with its ends disposed alongside the articles, elevating said end wall forming panels above the handle and the tops of the articles, and folding said end wall forming panels outwardly and downwardly to positions adjacent and alongside the end articles.

8. A method according to claim 7 wherein said supplementary side wall forming panels are elevated and folded outwardly and downwardly in coordination with the associated end wall forming panels.

9. A method according to claim 7 wherein said web panels are folded into positions between the associated side wall forming panel and supplementary side wall forming panel in coordination with outward and downward folding of said end wall forming panels.

* * * * *